US009670718B2

(12) United States Patent
Yager Grad et al.

(10) Patent No.: US 9,670,718 B2
(45) Date of Patent: Jun. 6, 2017

(54) QUICK FIT GATE

(71) Applicant: Northstates Industries, Inc., Blaine, MN (US)

(72) Inventors: Julie Ann Yager Grad, Deephaven, MN (US); Jon D. Robinson, Appleton, WI (US); Steven Scott Vergin, Cumberland, WI (US); James Patrick Moorman, Bloomington, MN (US); Paul Anthony Pilosi, Minnetonka, MN (US); Caleb Summers, St. Louis Park, MN (US)

(73) Assignee: NORTH STATES INDUSTRIES, INC., Blaine, MN (US)

( * ) Notice: Subject to any disclaimer, the term of this patent is extended or adjusted under 35 U.S.C. 154(b) by 0 days.

(21) Appl. No.: 14/219,702

(22) Filed: Mar. 19, 2014

(65) Prior Publication Data

US 2015/0267463 A1 Sep. 24, 2015

(51) Int. Cl.

| | |
|---|---|
| ***E06B 9/06*** | (2006.01) |
| ***E05B 65/00*** | (2006.01) |
| *E06B 9/00* | (2006.01) |

(52) U.S. Cl.

CPC ..... *E06B 9/06* (2013.01); *E05B 65/0007* (2013.01); *E05B 65/0014* (2013.01); *E06B 2009/002* (2013.01); *Y10T 292/307* (2015.04)

(58) Field of Classification Search

CPC .... E05B 65/0007; E05B 65/0014; E06B 9/06; E06B 2009/002; Y10S 292/29

USPC ..... 49/55, 53; 292/267, 268, 270, 219, 220

See application file for complete search history.

(56) References Cited

U.S. PATENT DOCUMENTS

| | | | | | |
|---|---|---|---|---|---|
| 1,646,899 | A * | 10/1927 | Frank-Cantrall | B61D 19/004 | 292/29 |
| 2,859,811 | A * | 11/1958 | Rusch | E06B 9/0623 | 160/136 |
| 3,148,725 | A * | 9/1964 | McPhaden | E06B 9/0623 | 160/161 |
| 3,431,966 | A * | 3/1969 | Injeski | E06B 9/02 | 160/225 |
| 3,489,201 | A * | 1/1970 | Curry | E06B 9/02 | 160/225 |
| 4,149,342 | A * | 4/1979 | Bowers | 49/55 | |
| 4,607,455 | A | 8/1986 | Bluem et al. | | |
| 4,831,777 | A * | 5/1989 | Johnson, Jr. | E06B 9/02 | 160/228 |
| 4,958,867 | A * | 9/1990 | Champagne | 292/259 R | |
| 5,535,552 | A | 7/1996 | Stern | | |
| 5,782,039 | A * | 7/1998 | Scherer et al. | 49/465 | |
| 5,865,485 | A * | 2/1999 | Lawhorne, Jr. | 292/289 | |
| 6,640,509 | B2 * | 11/2003 | Clewis | 52/202 | |
| 6,681,523 | B1 | 1/2004 | Stener | | |
| 7,658,220 | B2 * | 2/2010 | Yates | 160/377 | |
| 8,261,490 | B2 * | 9/2012 | Flannery et al. | 49/55 | |

(Continued)

*Primary Examiner* — Gregory J Strimbu
*Assistant Examiner* — Marcus Menezes
(74) *Attorney, Agent, or Firm* — Merchant & Gould P.C.

(57) ABSTRACT

A pressure-mounted gate includes a first panel extending horizontally. A second panel is slidably coupled to the first panel. The second panel extends horizontally. A locking mechanism is coupled to the first panel and the second panel. The locking mechanism facilitates a widening of the gate by a ratcheting structure. The locking mechanism locks a position of the first panel and the second panel at a desired gate width.

17 Claims, 11 Drawing Sheets

(56) References Cited

U.S. PATENT DOCUMENTS

| | | | | |
|---|---|---|---|---|
| 8,578,656 | B2 * | 11/2013 | Yates et al. | 49/465 |
| 2006/0027798 | A1 * | 2/2006 | Winston | 256/65.01 |
| 2007/0017156 | A1 * | 1/2007 | Robinson et al. | 49/55 |
| 2015/0075079 | A1 * | 3/2015 | Sundberg et al. | 49/465 |

* cited by examiner

FIG. 2
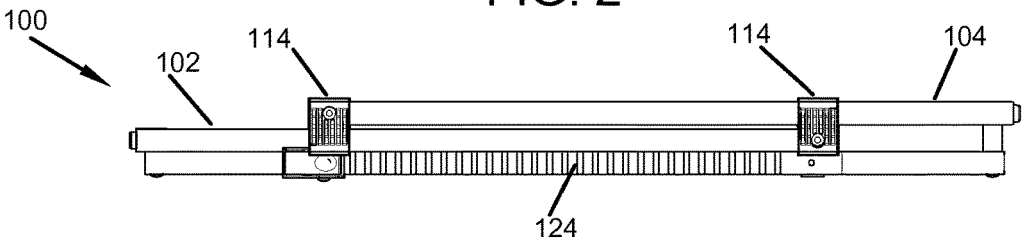
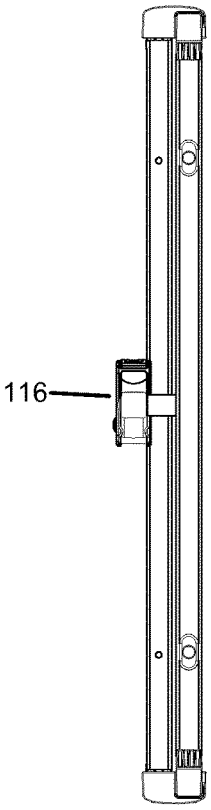
FIG. 3

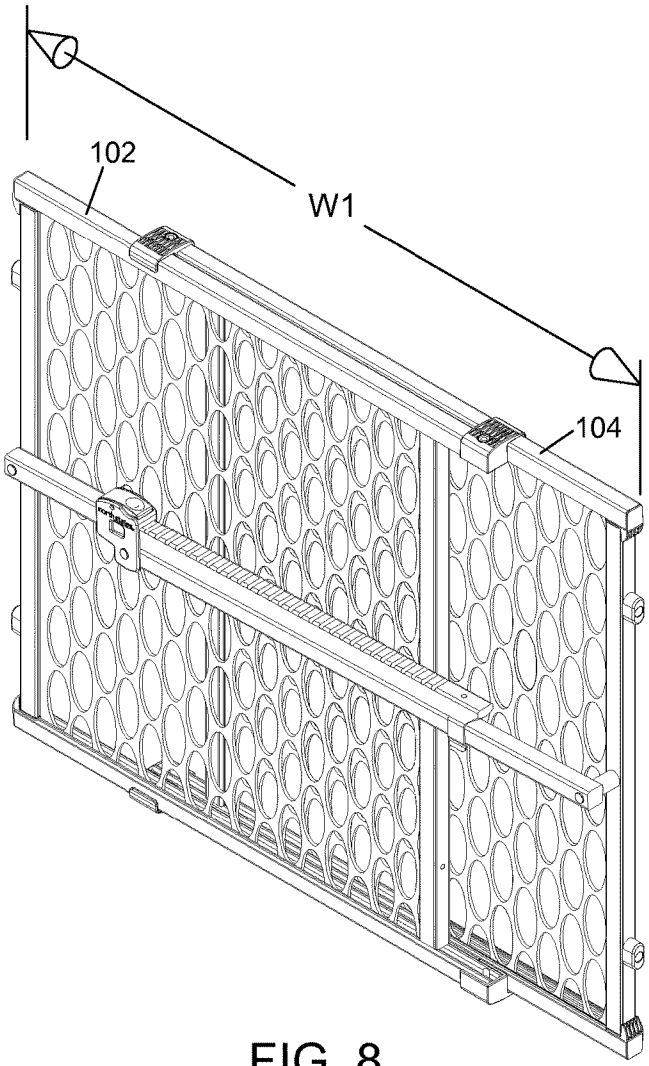
FIG. 8
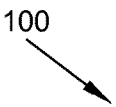

QUICK FIT GATE

BACKGROUND

Security gates are commonly used to lock or close passageways such as conventional doorways and entrances to stairwells. The purpose of such gates is primarily security, such as keeping small children from accessing stairwells that could present a hazard, and also confinement, such as confining a pet to a particular room during the night. Many types of child and pet security gates are available on the market today that range from the accordion style gates formed from lattice-connected wood slats to lightweight plastic injected molded gates that permit adjustment to width and closure.

A typical security gate is formed from one or more panels, each panel including a frame surrounding a mesh or other similar lattice structure formed therebetween. The mesh is typically used so that one can see through the gate when the gate is in place.

Typically, each panel is manually positioned between two stationary elements, such as a door jamb. The security gate is then locked in place by a locking mechanism. However, some locking mechanisms only provide a selection of discrete gate positions in which the gate may be locked. The discrete positions provided may not permit the gate to fit tightly within the stationary objects. Furthermore, once the gate is unlocked and the gate is removed from between the stationary objects, the position of the panels is changed. To re insert the gate between the stationary objects, the panels need to be manually positioned again.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Embodiments described herein relate to a quick fit gate. In one embodiment, a pressure-mounted gate includes a first panel extending horizontally; a second panel slidably coupled to the first panel, the second panel extending horizontally; and a locking mechanism coupled to the first panel and the second panel, the locking mechanism facilitating a widening of the gate by a ratcheting structure, the locking mechanism locking a position of the first panel and the second panel at a desired gate width.

In another embodiment, a method of adjusting and locking a pressure-mounted gate comprises sliding two panels of the gate away from each other so that a width of the gate is increased and the gate is positioned to fit loosely between two stationary objects; lifting a first arm of the gate, a first end of the first arm being attached to a first panel of the gate; when the first arm of the gate is lifted a distance greater than a threshold distance, sliding a locking mechanism attached to a second arm of the gate along a portion of the first arm of the gate; and after the first arm is lifted a distance greater than the threshold distance, lowering the first arm of the gate, the lowering of the first arm of the gate causing the second arm to move a second panel of the gate horizontally away from the first panel of the gate, the lowering of the first arm of the gate causing the gate to tighten against the two stationary objects.

In yet another embodiment, a locking mechanism for a gate comprises a housing that is configured to be pivotably attached to a first end of a first arm and slidably attached to a second arm; a cover for the housing, the cover for the housing including a pawl on one end of the cover; and a spring attached to a top of the housing and pressed against an inside of the cover for the housing, wherein when the spring is compressed, the pawl moves up a distance from the top of the housing.

BRIEF DESCRIPTION OF THE DRAWINGS

Reference will now be made to the accompanying drawings, which are not necessarily drawn to scale, and wherein:

FIG. 2 is a top view of the gate of FIG. 1.

FIG. 3 is a side view of the gate of FIG. 1.

FIG. 8 is a perspective view of a locked position of the gate of FIG. 1.

DETAILED DESCRIPTION

Embodiments will now be described more fully hereinafter with reference to the accompanying drawings. Principles associated with this disclosure can, however, be embodied in many different forms and should not be construed as limited to the embodiments set forth herein. Instead, these embodiments are provided so that this disclosure will be thorough and complete, and will fully convey principles of the disclosure to those skilled in the art. Like numbers refer to like elements throughout.

Embodiments of the present disclosure relate to quick fit gates, such as security gates for pets and children. Example gates described herein include a ratcheting mechanism that permits a gate to slide and that includes a bar and locking structure that permits the gate to expand in length incrementally. The locking structure also locks the gate in place when the bar is moved down.

Figure 1:
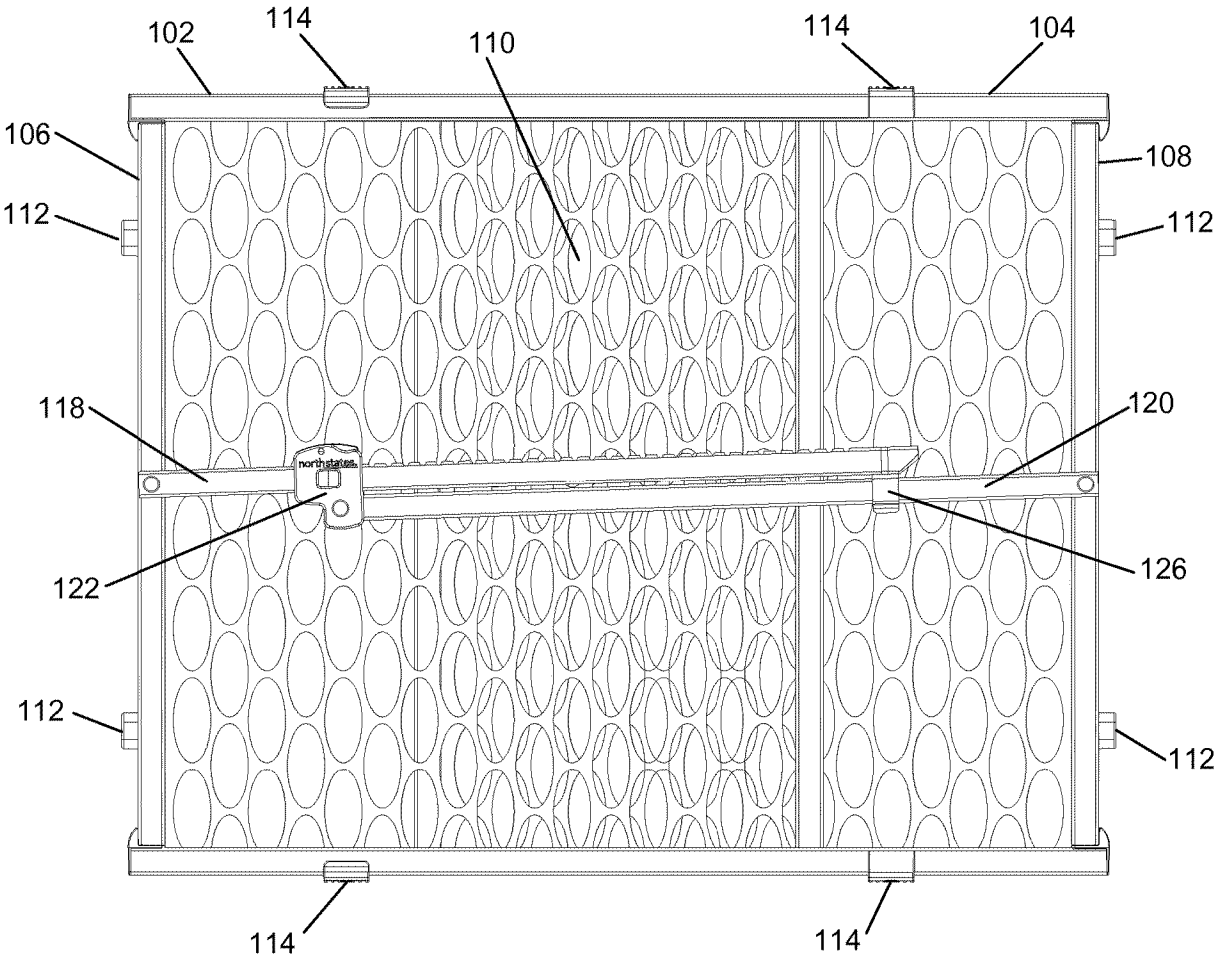
FIG. 1 is a front view of an example quick fit gate.

Referring now to FIGS. 1-3, a quick fit gate 100 is shown. Gate 100 includes panels 102, 104. Each panel 102, 104 includes a frame 106, 108 surrounding a lattice structure formed by a mesh 110. Panels 102, 104 are slideably connected for adjustment to a desired width to define a closure between two stationary elements such as, for example, a doorjamb. A fastener 114 is connected to a top and bottom of each panel 102, 104 to secure panel 102 to panel 104. In addition, a pair of rubber bumpers 112 is connected to the side face of each frame 106, 108 to frictionally engage the stationary elements.

Gate 100 also includes a locking structure 116 for locking panels 102, 104 at a desired width. Locking structure 116 includes a first arm 118 pivotally attached to frame 106 at a first end. A second arm 120 is pivotally attached to frame 108 at a first end. A locking mechanism 122 attached to a second end of second arm 120 is configured to engage one of a plurality of notches 124 formed on an upper surface of first arm 118, and a clip mechanism 126 on a second end of first arm 118 is configured to engage and couple first arm 118 to second arm 120. Locking structure 116 is configured to position and maintain panels 102, 104 at a desired width by ratcheting first arm 118 to the desired width and locking clip mechanism 126 to second arm 120. Locking mechanism 122 also permits gate 100 to maintain a memory of the desired width when gate 100 is removed from between the stationary elements.

Frames 106, 108, first arm 118 and second arm 120 can be made of a variety of materials, such as metal, plastic, or wood. In the example shown, frames 106, 108, first arm 118 and second arm 120 are made of wood. In other embodiments, frames 106, 108, first arm 118 and second arm 120 can be made of different materials. For example, frames 106, 108 and second arm 120 can be made of wood, and first arm 118 can be made of metal or plastic.

In addition, mesh 110 can be configured in a variety of patterns and can be made of a variety of materials such as metal, plastic or wood. In the example shown, mesh 110 forms a lattice structure and is made of plastic.

Figure 4:
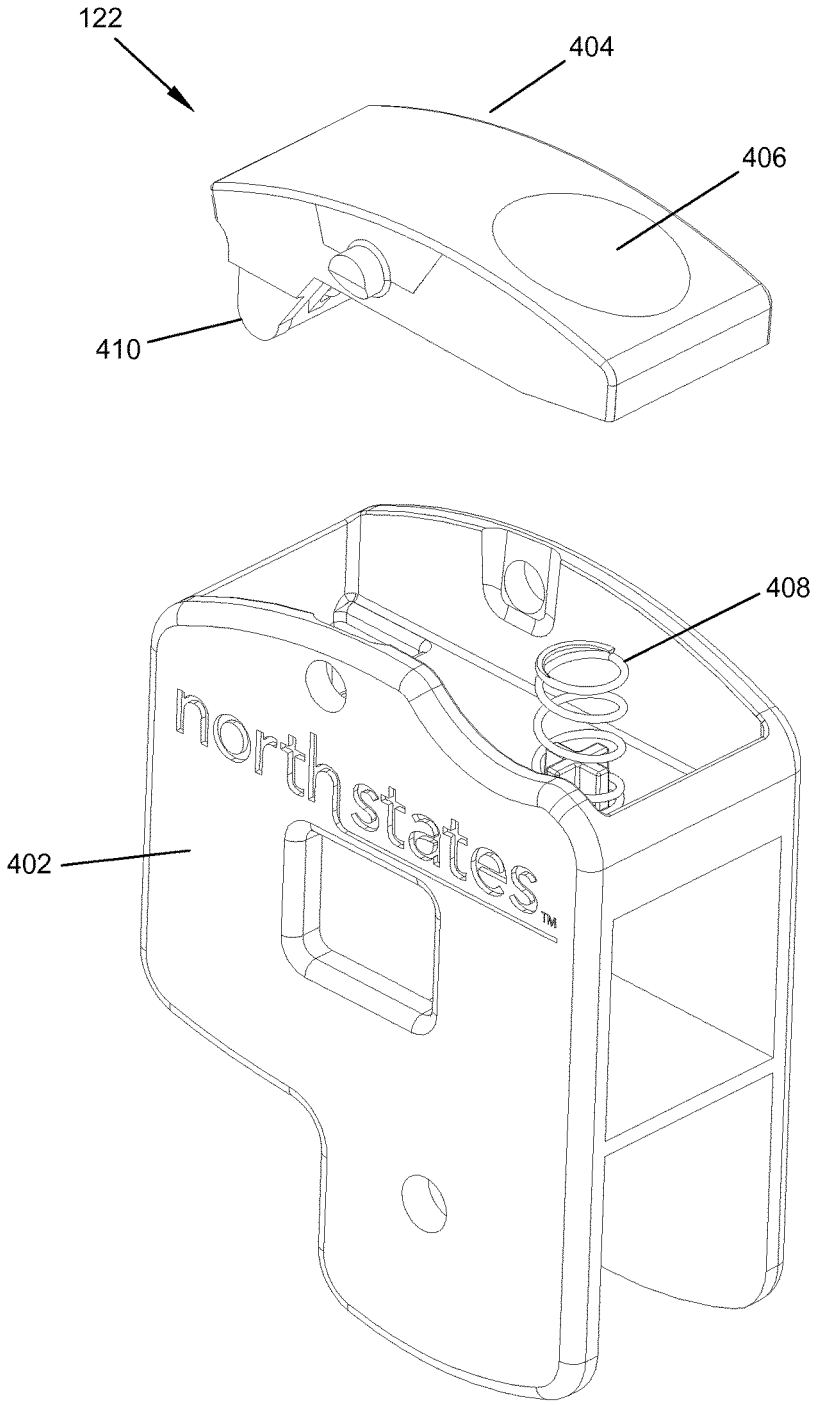
FIG. 4 is an exploded view of the locking mechanism of FIG. 1.

FIG. 4 shows an exploded view of the locking mechanism 122. The locking mechanism 122 includes a main housing 402 and a control mechanism 404. The control mechanism 404 includes a button 406 and a pawl 410. When the gate 100 is locked, the pawl 410 is inserted into one of the notches 124 on the first arm 118, as explained in more detail later herein. The button 406 provides a means for releasing the pawl 410 from a locked position, so that panels 102 and 104 can move with respect to each other. The button 406 makes contact with a spring 408 on the main housing 402. When the button 406 is pressed down against the spring 408, the pawl 410 is lifted up from the notches 124, unlocking gate 100. Typically, the button 406 is used to unlock the gate 100 so that the width of gate 100 may be made smaller. To increase the width of gate 100, ratcheting is typically used, as explained later herein.

Figure 5:
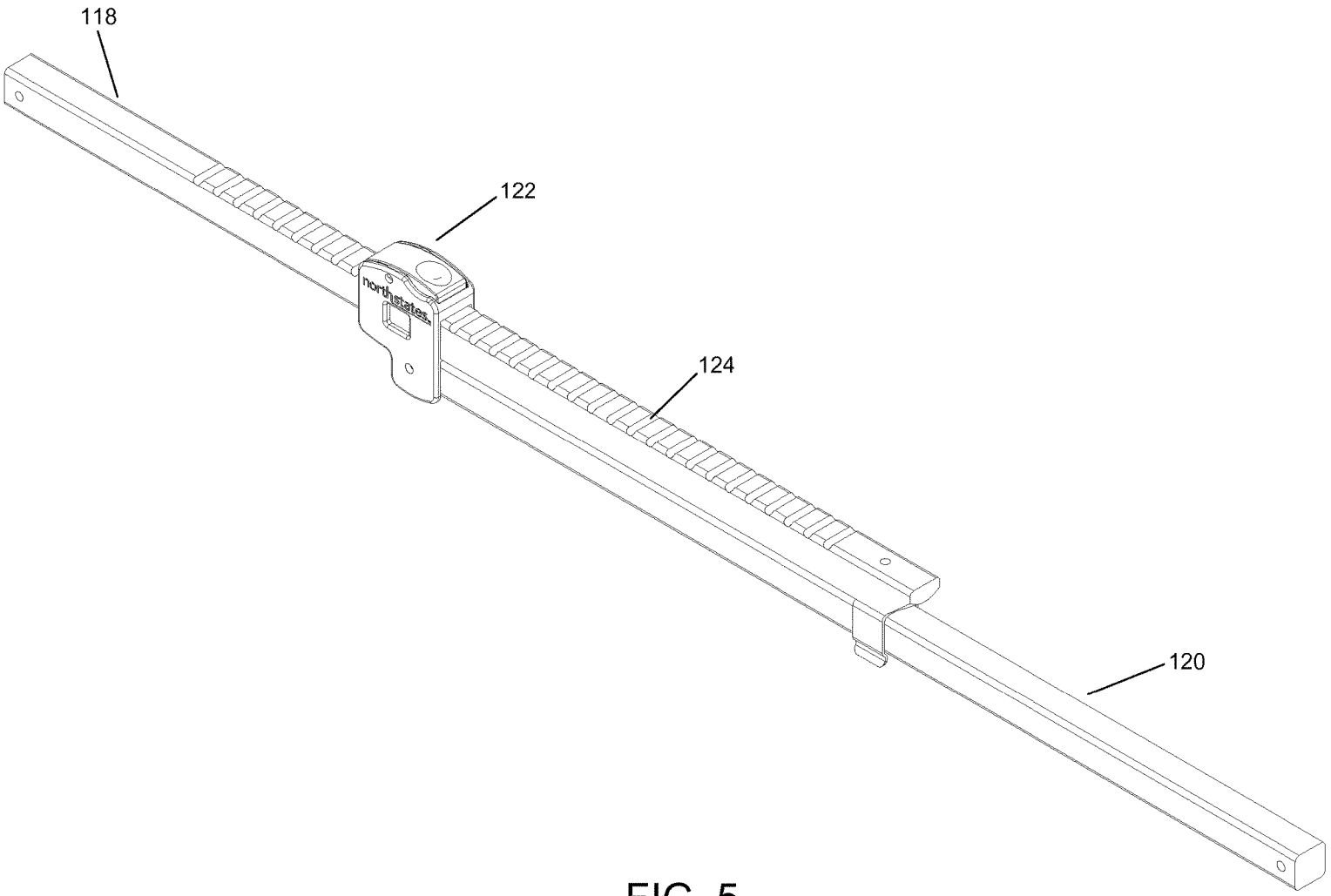
FIG. 5 is a perspective view of the arm bars and locking mechanism of FIG. 1.

FIG. 5 shows a more detailed view of the notches 124 on the upper surface of the first arm 118. When the pawl 410 is inserted into a notch, first arm 118 is prevented from moving with respect to the second arm 120 and the gate 100 is locked. When the pawl 410 is released from the notch, first arm 118 is free to move with respect to the second arm 120. Because frame 106 of panel 102 is connected to first arm 118 and because frame 108 of panel 104 is connected to second arm 120, when pawl 410 is released from the notch, panel 102 is permitted to move with respect to panel 104.

Figure 6:
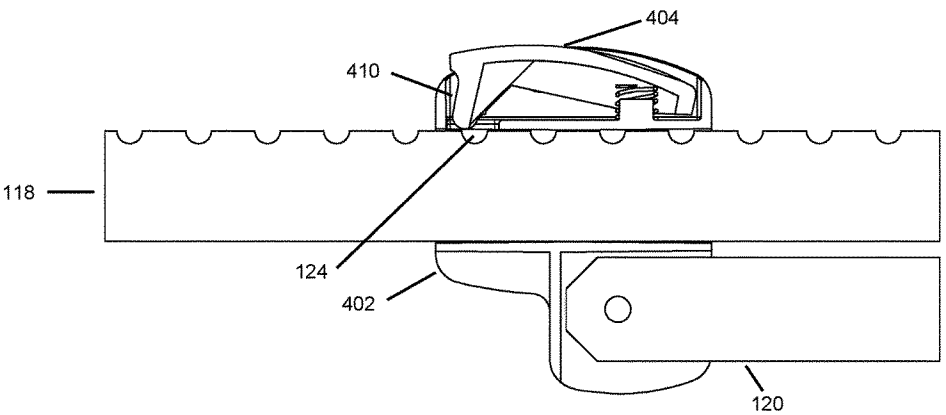
FIG. 6 is a front view of a released position of a pawl of the locking mechanism of FIG. 1.
Figure 7:
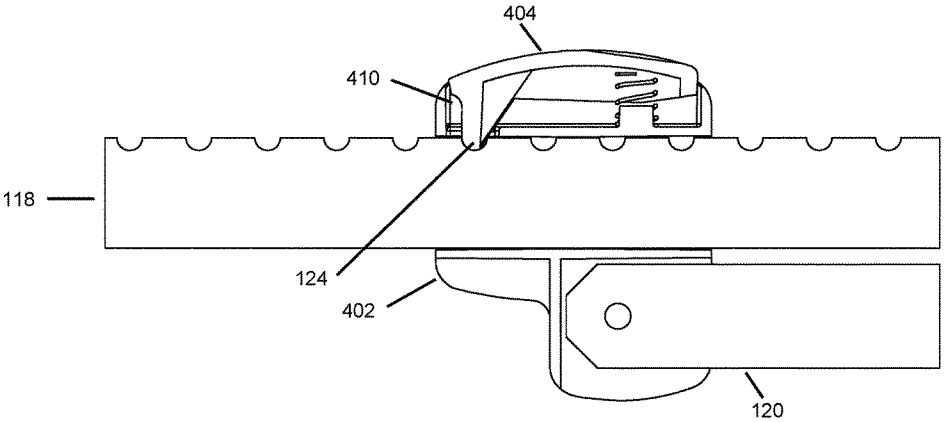
FIG. 7 is a front view of a locked position of the pawl of the locking mechanism of FIG. 1.

As shown in FIG. 6, when pawl 410 is released from a notch 124, pawl 410 no longer holds first arm 118 in place. First arm 118 is free to move with respect to second arm 120. As shown in FIG. 7, when pawl 410 is inserted into the notch 124, pawl 410 prevents first arm 118 from moving with respect to second arm 120. As a result, gate 100 is locked.

Figure 9:
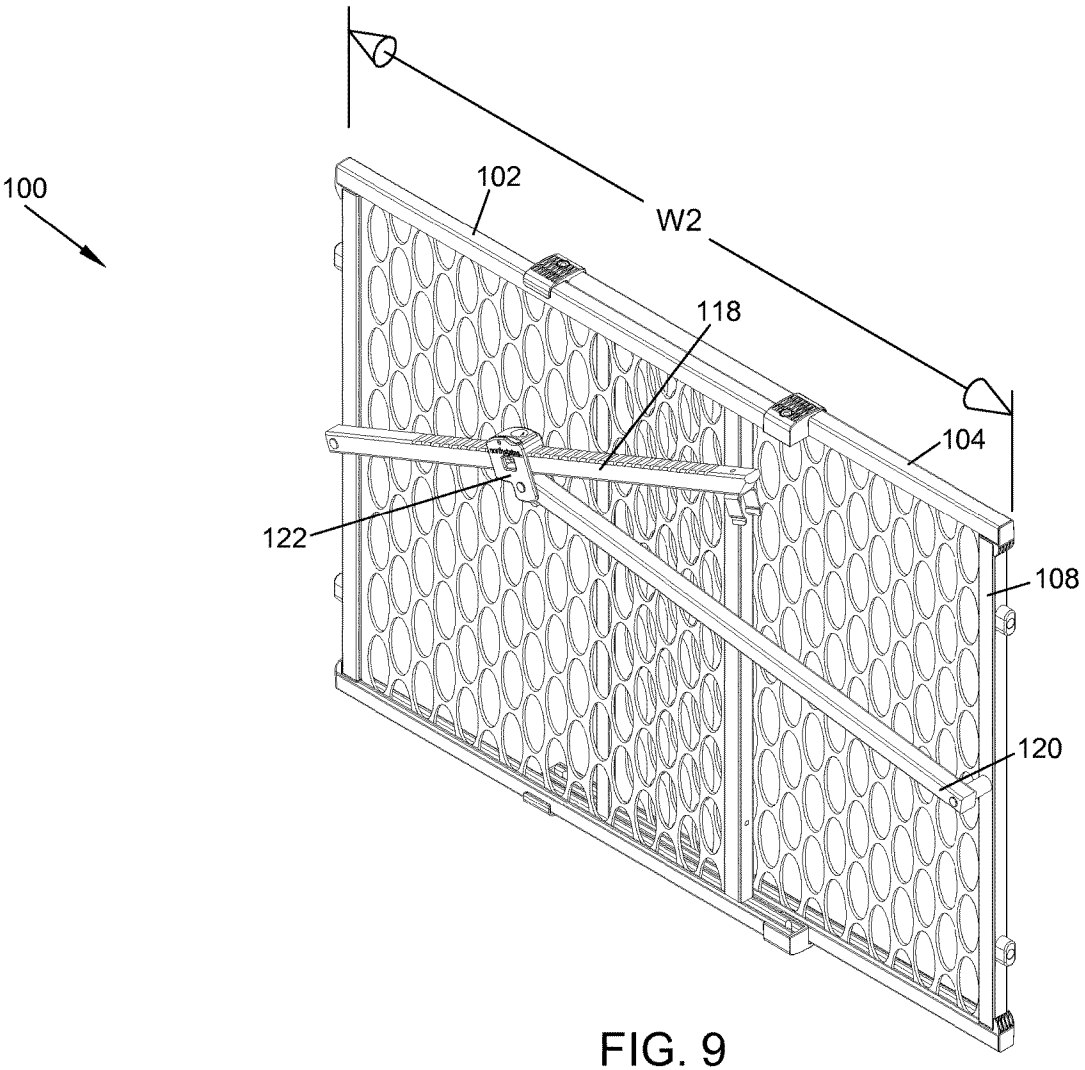
FIG. 9 is a perspective view of an unlocked locked position of the gate of FIG. 1.
Figure 10:
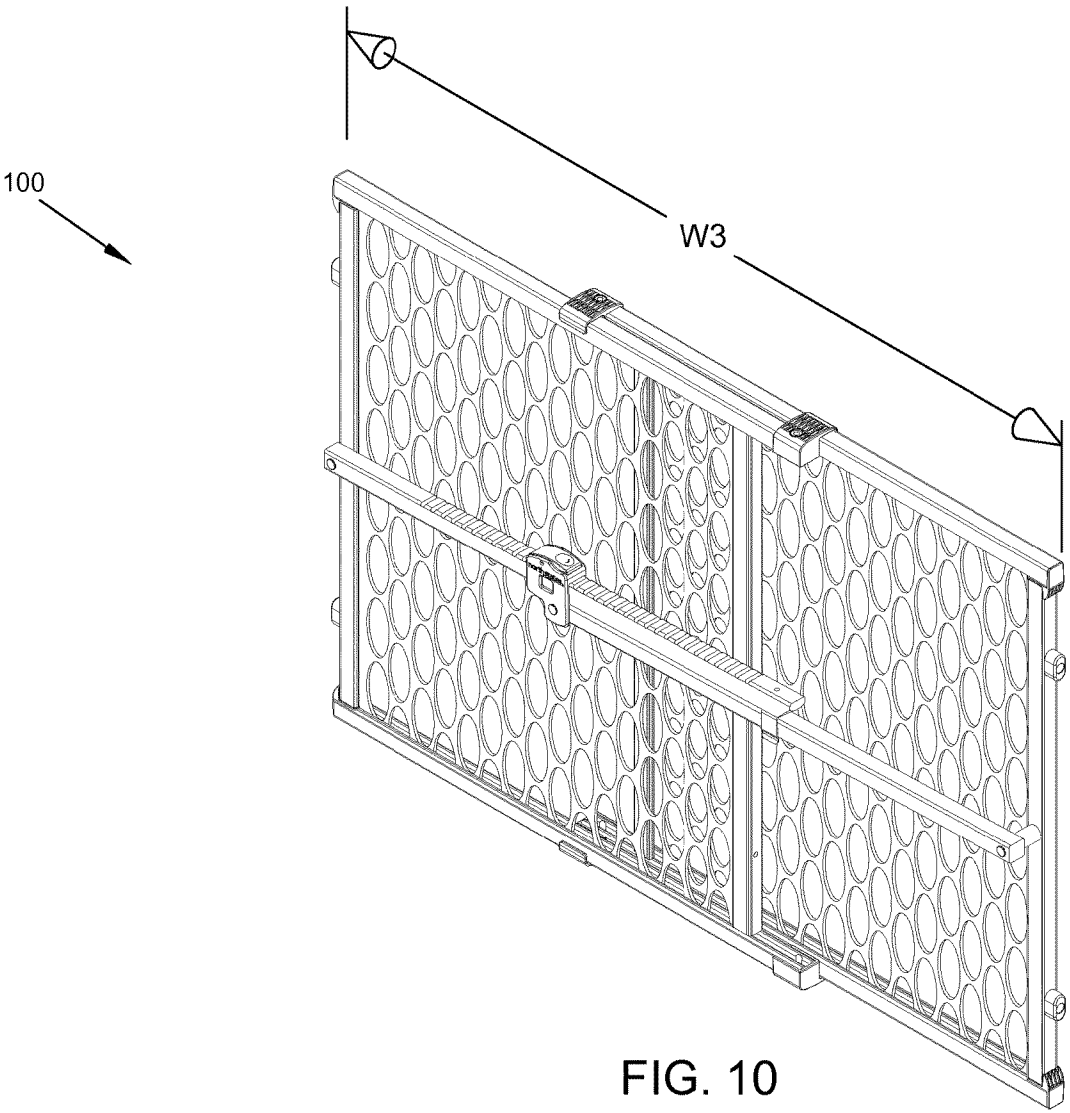
FIG. 10 is another perspective view of a locked position of the gate of FIG. 1.

Referring to FIGS. 8-10, a sequence is shown for adjusting a width of gate 100 between two stationary objects. In the sequence shown in FIGS. 8-10, the width is increased from a width W1 to a width W3. FIG. 8 shows gate 100 in a locked position at width W1. In order to increase the width of gate 100, panels 102 and 104 are pulled away from each other until gate 100 fits loosely between the two stationary objects. This increases the width of gate 100 to a width W2. When panels 102 and 104 are pulled away from each other, the force of pulling panels 102 and 104 away from each other allows pawl 410 to ratchet along notches 124 until the width W2 is reached.

Width W2 represents an approximate distance between the two stationary objects. In order for gate 100 to fit tightly between the two stationary objects, additional ratcheting is typically required. To implement the additional ratcheting, first arm 118 is lifted off second arm 120 (FIG. 9). When first arm 118 is lifted a specific distance off second arm 120, locking mechanism 122 ratchets along notches 124 of first arm 118. The specific distance corresponds to a threshold distance that first arm 118 needs to be lifted to release pawl 410 from a notch in first arm 118.

Locking mechanism 122 typically ratchets one or two notches when first arm 118 is lifted the threshold distance off second arm 120. When locking mechanism 122 ratchets, the locking mechanism 122 moves up first arm 118 towards panel 104. Because locking mechanism 122 is also connected to second arm 120 and second arm 120 is connected to panel 104, panel 104 moves to the right when locking mechanism 122 ratchets.

Ratcheting occurs because when first arm 118 is lifted off of second arm 120, button 406 of control mechanism 404 presses down on spring 408. When button 406 presses down on spring 408, pawl 410 lifts up from the notch of notches 124 in which pawl 410 is inserted. As first arm 118 continues to be lifted, pawl 410 slides one or two notches forward in notches 124. The ratcheting only moves locking mechanism 122 in one direction, towards frame 108 of panel 104. Because second arm 120 is attached to locking mechanism 122, when locking mechanism 122 moves towards frame 108 of panel 104, panel 104 moves away from panel 102, thereby widening gate 100.

First arm 118 is then lowered towards second arm 120 and secured into place on second arm 120 via clip mechanism 126 (FIG. 10). When first arm 118 is lowered, pressure is applied against second arm 120. The pressure may cause second arm 120 to move further and tighten gate 100 between the two stationary objects. This increases the width of gate 100 to a width W3.

Figure 11:
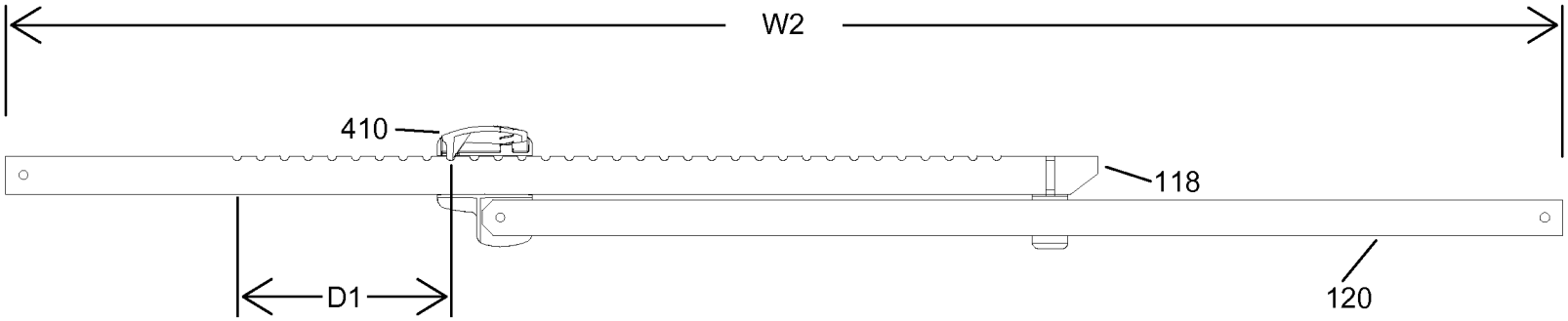
FIG. 11 is a front view of a locked position of the gate of FIG. 1.
Figure 12:
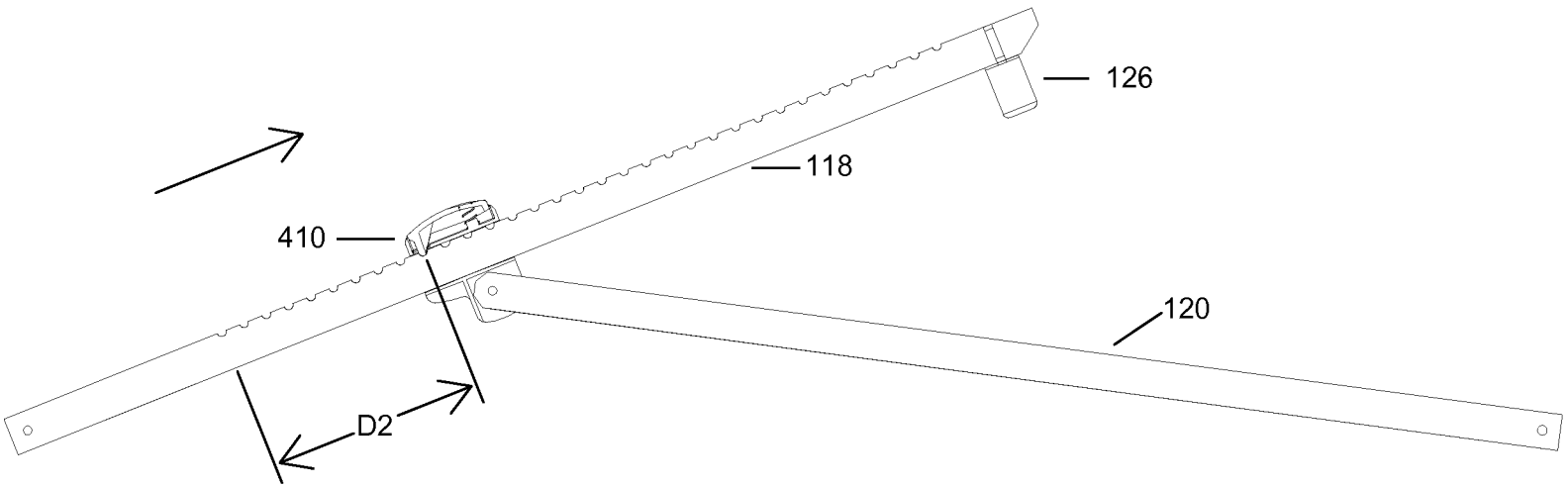
FIG. 12 is a front view of an unlocked position of the gate of FIG. 1.
Figure 13:
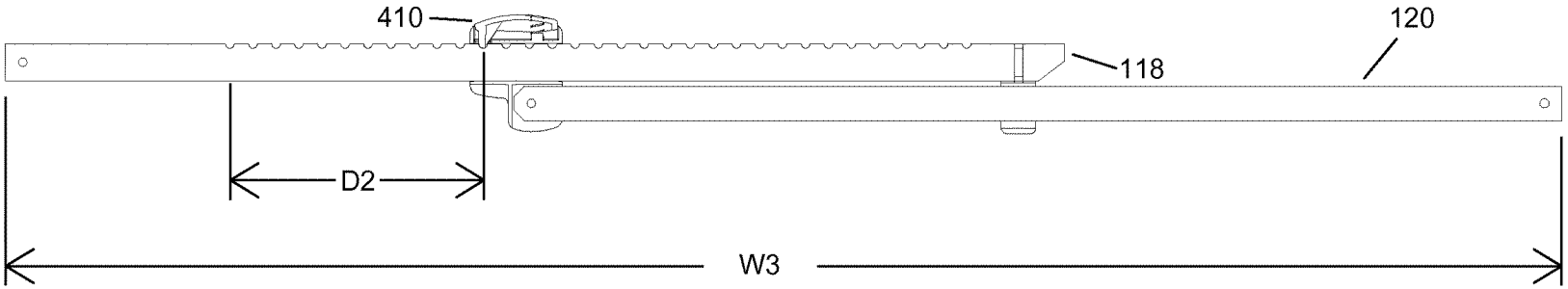
FIG. 13 is another front view of a locked position of the gate of FIG. 1.

Referring now to FIGS. 11-13, a sequence is shown for tightening gate 100 from a width W2 to a width W3. FIG. 11 shows gate 100 at a width W2 with first arm 118 and second arm 120 in a closed position. As discussed, width W2 represents a distance in which gate W2 fits loosely between the two stationary objects. As shown in FIG. 11, pawl 410 is inserted in a notch of first arm 118 that is a distance D1 from a start of the notches on first arm 118.

When first arm 118 is lifted (FIG. 12), and moved higher than the threshold distance, pawl 410 is released from first arm 118 and ratcheted up one or two notches on first arm 118. The threshold distance is a distance that first arm 118 needs to be lifted in order for pawl 410 to be released from the notch that is a distance D1 from the start of the notches on first arm 118. After pawl 410 is ratcheted up one or two notches on first arm 118, pawl 410 is now inserted in a notch at a distance D2 from the start of the notches on first arm 118, where D2 is greater than D1.

First Arm 118 is now lowered so that clip mechanism 126 of first arm 118 is clipped onto second arm 120 (FIG. 13). Because the distance from pawl 410 to the start of the notches on first arm 118 is now D2, when first arm 118 is lowered onto second arm 120 and clipped onto second arm 120, pressure is applied to first arm 118 that causes second arm 120 to tighten against the stationary elements on either end of gate 100 and expand gate 100 to a width of W3, where W3 is slightly greater than W2.

When gate 100 is to be removed from between the two stationary objects, first arm 118 is lifted enough so that gate 100 can be removed. However, when gate 100 is removed, pawl 410 remains in the notch that is a distance D2 from the start of the notches on first arm 118. Because pawl 410 remains in the notch, gate 100 retains a memory of width W2. Therefore, gate 100 can be put aside and then reinserted between the two stationary objects without needing to resize the width of gate 100.

The various embodiments described above are provided by way of illustration only and should not be construed to limit the disclosure. Those skilled in the art will readily recognize various modifications and changes that may be made to the present disclosure without following the example embodiments and applications illustrated and described herein, and without departing from the true spirit and scope of the present disclosure, which is set forth in the following claims.

What is claimed is:

1. A pressure-mountable gate for positioning between two stationary objects, the pressure-mountable gate comprising:

a first gate panel;

a second gate panel slidably coupled to the first gate panel, the first and second gate panels together forming the pressure-mountable gate having opposite ends, the first and second gate panels being adjustable to set the pressure-mountable gate at a selected gate width;

bumpers at the opposite ends of the pressure-mountable gate, the bumpers being positioned to engage the stationary objects when the pressure-mountable gate is mounted between the stationary objects;

a lever arm arrangement comprising a first arm and a second arm, the first arm comprising a first end and a second end and a plurality of notches disposed between the first end and the second end, the first arm being pivotally attached to the first gate panel at a first pivot point, and the second arm being pivotally attached to the second gate panel at a second pivot point;

a pivot slide arrangement mounted on the first and second arms, the pivot slide arrangement having a pivotable connection on the second arm and a slidable connection with the first arm, the pivot slide arrangement including a locking mechanism, the locking mechanism including:

a main housing; and a control mechanism; the main housing defining a channel through which the first arm slideably extends, the control mechanism including a pivotable pawl engageable in a selected one of the plurality of notches to lock the first and second gate panels of the pressure-mountable gate at the selected gate width; the pivotable pawl being removable from the selected one of the plurality of notches to unlock the first and second gate panels of the pressure-mountable gate, and thus to allow the first and second gate panels to slide relative to one another;

a first portion of the first arm extending between the first pivot point of the first arm and the pivot slide arrangement, and a second portion of the first arm extending between the pivot slide arrangement and the second end of the first arm;

wherein, as the second portion of the first arm is pivoted away from the second arm, the pressure-mountable gate shortens a distance between the first and second pivot points and the opposite ends of the pressure-mountable gate move toward one another;

wherein, as the second portion of the first arm is pivoted toward the second arm, the pressure-mountable gate lengthens the distance between the first and second pivot points and the opposite ends of the pressure-mountable gate move away from one another;

the locking mechanism, when in a locked configuration, having the pivotable pawl resiliently biased into the selected one of the plurality of notches; and as the first arm is pivoted less than a threshold distance away from the second arm, the pressure-mountable gate shortens adequately to release mounting pressure sufficiently for disengagement from the stationary objects while maintaining the pivotable pawl biased into the selected one of the plurality of notches, and without adjusting the selected gate width; and the locking mechanism, when in an unlocked configuration, allowing for adjustment of the selected gate width.

2. The pressure-mountable gate of claim 1, wherein the first panel and the second panel each include a lattice mesh structure.

3. The pressure-mountable gate of claim 1, wherein the bumpers comprise rubber material.

4. The pressure-mountable gate of claim 1, wherein a first end of the pressure-mountable gate has at least two bumpers, and an opposite second end of the pressure mountable gate has at least two bumpers.

5. The pressure-mountable gate of claim 1, further comprising a clip mechanism on the second end of the first arm, the clip mechanism being configured to couple the first arm to the second arm when the first arm is pivoted sufficiently to move the second end of the first arm adjacent the second arm.

6. The pressure-mountable gate of claim 1, wherein the control mechanism comprises a pivotably mounted lever with the pivotable pawl on one end thereof.

7. The pressure-mountable gate of claim 6, wherein the main housing of the locking mechanism has side walls on opposite sides of the channel, and the control mechanism is pivotably mounted in a position between the side walls of the main housing.

8. The pressure-mountable gate of claim 7, wherein the control mechanism includes a first pivot pin pivotably engaging a first side wall of the main housing, and a second opposite pivot pin pivotably engaging a second opposite side wall of the main housing.

9. The pressure-mountable gate of claim 8, wherein the control mechanism further comprises a spring positioned to bias the pivotably mounted lever sufficiently to drive the pivotable pawl in a direction towards the first end of the first arm.

10. The pressure-mountable gate of claim 9, wherein the spring engages the pivotably mounted lever of the control mechanism at a location with the first and second pivot pins positioned between the location and the pivotable pawl.

11. The pressure-mountable gate of claim 1, wherein the control mechanism further comprises a spring positioned to bias the pivotable pawl in a direction towards the first end of the first arm.

12. The pressure-mountable gate of claim 11, wherein the control mechanism comprises a pivotably mounted lever having a first end and an opposite second end, the pivotable pawl positioned at the first end of the pivotably mounted lever, and the spring engaging a portion of the pivotably mounted lever at the second end of the pivotably mounted lever.

13. The pressure-mountable gate of claim 1, wherein the first and second arms comprise of wood.

14. The pressure-mountable gate of claim 1, wherein the first and second arms comprise of plastic.

15. The pressure-mountable gate of claim 1, wherein the first and second arms comprise of metal.

16. The pressure-mountable gate of claim 1, wherein:

a first end of the pressure-mountable gate has at least two bumpers, and an opposite second end of the pressure mountable gate has at least two bumpers;

the main housing of the locking mechanism has side walls on opposite sides of the channel;

the control mechanism includes a pivotably mounted lever with the pivotable pawl on one end thereof;

the control mechanism is pivotably mounted in a position between the side walls of the main housing; and the control mechanism further comprises a spring positioned to bias the pivotable pawl in a direction towards the first end of the first arm.

17. The pressure-mountable gate of claim 16, wherein the control mechanism includes first and second opposite pivot pins respectively engaging one of the side walls of the main housing.

* * * * *